US012104328B2

(12) United States Patent
Kou et al.

(10) Patent No.: US 12,104,328 B2
(45) Date of Patent: Oct. 1, 2024

(54) TURNOUT APPARATUS FOR OVERHEAD MONORAIL

(71) Applicant: TAIYUAN UNIVERSITY OF TECHNOLOGY, Shanxi (CN)

(72) Inventors: Ziming Kou, Shanxi (CN); Guijun Gao, Shanxi (CN); Jing Zhang, Shanxi (CN); Fuli Sun, Shanxi (CN); Jiabao Xue, Shanxi (CN)

(73) Assignee: TAIYUAN UNIVERSITY OF TECHNOLOGY, Shanxi (CN)

( * ) Notice: Subject to any disclaimer, the term of this patent is extended or adjusted under 35 U.S.C. 154(b) by 862 days.

(21) Appl. No.: 17/279,103

(22) PCT Filed: Apr. 3, 2019

(86) PCT No.: PCT/CN2019/081328
§ 371 (c)(1),
(2) Date: Mar. 24, 2021

(87) PCT Pub. No.: WO2020/172949
PCT Pub. Date: Sep. 3, 2020

(65) Prior Publication Data

US 2021/0388562 A1 Dec. 16, 2021

(30) Foreign Application Priority Data

Feb. 25, 2019 (CN) ..... 201910139054

(51) Int. Cl.
*E01B 25/26* (2006.01)
*B61B 13/04* (2006.01)
(Continued)

(52) U.S. Cl.
CPC ..... *E01B 25/26* (2013.01); *B61B 13/04* (2013.01); *B61L 5/04* (2013.01); *E01B 5/14* (2013.01); *E01B 2202/044* (2013.01)

(58) Field of Classification Search
CPC ..... E01B 5/14; E01B 25/26; E01B 2202/044; B61B 13/04; B61L 5/04
See application file for complete search history.

(56) References Cited

FOREIGN PATENT DOCUMENTS

| | | |
|---|---|---|
| CN | 2350426 | 11/1999 |
| CN | 102677552 | 9/2012 |

(Continued)

OTHER PUBLICATIONS

"International Search Report (Form PCT/ISA/210) of PCT/CN2019/081328", mailed on Nov. 26, 2019, with English translation thereof, pp. 1-6.

*Primary Examiner* — Robert J McCarry, Jr.
(74) *Attorney, Agent, or Firm* — JCIP GLOBAL INC.

(57) ABSTRACT

A turnout apparatus for an overhead monorail includes a frame, an input fixed rail docking an input rail, output fixed rails each docking an output rail, and movable rails disposed between the input fixed rail and the output fixed rails. The input fixed rail is disposed at one end of the frame. The output fixed rails include a first output fixed rail and a second output fixed rail disposed at the other end of the frame. The movable rails include a first movable rail docking the input fixed rail and the first output fixed rail, and a second movable rail docking the input fixed rail and the second output fixed rail. The first and second movable rails are fixed and rotatable about a horizontal line as an axis. Directions toward which upper rail surfaces of the first movable rail and the second movable rail face differ by 180 degrees.

10 Claims, 5 Drawing Sheets

(51) Int. Cl.
*B61L 5/04* (2006.01)
*E01B 5/14* (2006.01)

(56) References Cited

FOREIGN PATENT DOCUMENTS

| | | | | | |
|---|---|---|---|---|---|
| CN | 102704357 | | | 10/2012 | |
| CN | 202577068 | | | 12/2012 | |
| CN | 202786986 | | | 3/2013 | |
| CN | 206553839 | | | 10/2017 | |
| CN | 206815109 | | | 12/2017 | |
| CN | 207537826 | | | 6/2018 | |
| CN | 207537826 | U | * | 6/2018 | ..... E01B 25/12 |
| DE | 4132924 | | | 2/1992 | |
| EP | 1947242 | | | 7/2008 | |

* cited by examiner

TURNOUT APPARATUS FOR OVERHEAD MONORAIL

CROSS-REFERENCE TO RELATED APPLICATION

This application is a 371 international application of PCT application serial no. PCT/CN2019/081328, filed on Apr. 3, 2019, which claims priority to Chinese Patent Application No. 201910139054.9, filed on Feb. 25, 2019. The entirety of each of the abovementioned patent applications is hereby incorporated herein by reference and made a part of this specification.

BACKGROUND

Technical Field

The present invention relates to railway vehicle technologies, and specifically to a turnout apparatus for an overhead monorail.

Description of Related Art

Overhead monorails are often used to transport goods and people in special occasions such as coal mine roadways, road tunnels, and railway tunnels. The main advantages of overhead monorail transportation include: first, the overhead monorail has a small cross-section and high utilization of the space of the roadway cross-section; second, it can be used for continuous non-reload transportation in flat and inclined roadways, and has a transport load unlimited by the floor conditions, and thus it can run on various vertical curves, horizontal curves and complex curves; and third, it can complete auxiliary transportation from the district station to the working face without reloading, and can be used for auxiliary transportation operations that connect the main transportation roadway with the mining area roadway.

When the overhead monorail is used in underground mining, a turnout apparatus is often needed, so as to allow the overhead monorail to reach more places. However, when an existing turnout apparatus changes the track, the movable guide rail and the fixed guide rail cannot be accurately docked, and there is an angle and gap between them. This gap causes the overhead monorail to be too bumpy when passing through the turnout apparatus, and causes wear to the wheels of the overhead monorail, resulting in safety risks and instability.

SUMMARY

In view of this, embodiments of the present invention provide a turnout apparatus for an overhead monorail, to enhance the safety and stability.

To achieve the above objective, the technical solutions of the embodiments of the present invention are implemented as follows.

The embodiments of the present invention provide a turnout apparatus for an overhead monorail. The turnout apparatus includes a frame, an input fixed rail configured to dock an input rail, output fixed rails each configured to dock an output rail, and movable rails disposed between the input fixed rail and the output fixed rails. The input fixed rail is disposed at one end of the frame, the output fixed rails include a first output fixed rail and a second output fixed rail, and the first output fixed rail and the second output fixed rail are disposed at the other end of the frame. The movable rails include a first movable rail configured for simultaneously docking the input fixed rail and the first output fixed rail, and a second movable rail configured for simultaneously docking the input fixed rail and the second output fixed rail. The first movable rail and the second movable rail are fixed together and are both rotatable about a horizontal line as an axis, and directions toward which upper rail surfaces of the first movable rail and the second movable rail face differ by 180 degrees in a circumferential direction.

In the above solution, the apparatus further includes a triangular bracket, the triangular bracket includes an input end corresponding to the input rail and an output end corresponding to the output rails, the input end and the output end are each provided with a shaft head, the triangular bracket is rotatably mounted on the frame through the shaft heads, and the frame is provided with supporting bearings engaged with the shaft heads. The first movable rail and the second movable rail are respectively fixed above and below the triangular bracket, and when the triangular bracket rotates, the first movable rail and the second movable rail both rotate about the horizontal line as the axis.

In the above solution, the apparatus further includes a driving device configured to drive the triangular bracket to rotate, and the driving device is disposed at the end of the frame corresponding to either the input end or the output end of the triangular bracket.

In the above solution, the frame further includes a limiting block configured to limit a rotation angle of the triangular bracket, and the limiting block is located within a rotation radius range of the triangular bracket. When the first movable rail simultaneously docks the input fixed rail and the first output fixed rail, an upper surface of the triangular bracket rests against the limiting block, and when the second movable rail simultaneously docks the input fixed rail and the second output fixed rail, a lower surface of the triangular bracket rests against the limiting block.

In the above solution, each of the movable rails is provided with arc-shaped sections docking the input fixed rail and a respective one of the output fixed rails in a traveling direction of the overhead monorail, and the arc-shaped sections are of a preset size.

In the above solution, each of the supporting bearings includes a bearing seat and a rolling bearing, the bearing seat is fixed on the frame, an outer race of the rolling bearing is fixed on the bearing seat, and an inner race of the rolling bearing is engaged with the shaft head of the triangular bracket.

In the above solution, the driving device is a first motor, and an output shaft of the first motor is connected to the shaft head of the triangular bracket.

In the above solution, the driving device includes a two-way hydraulic pump, a first hydraulic cylinder and a second hydraulic cylinder, the two-way hydraulic pump includes a first oil outlet and a second oil outlet respectively connected to the first hydraulic cylinder and the second hydraulic cylinder, and piston rods of the first hydraulic cylinder and the second hydraulic cylinder are each connected to the shaft head of the triangular bracket through a pinion and rack mechanism. When oil is delivered out from the first oil outlet of the two-way hydraulic pump, the first hydraulic cylinder drives, through the pinion and rack mechanism, the shaft head of the triangular bracket to rotate clockwise. When oil is delivered out from the second oil outlet of the two-way hydraulic pump, the second hydraulic cylinder drives, through the pinion and rack mechanism, the shaft head of the triangular bracket to rotate counterclockwise.

In the above solution, the driving device further includes a second motor configured to drive the two-way hydraulic pump, oil is delivered out from the first oil outlet of the two-way hydraulic pump when the second motor rotates clockwise, and oil is delivered out from the second oil outlet of the two-way hydraulic pump when the second motor rotates counterclockwise.

In the above solution, the first movable rail and the second movable rail are each fixed to the triangular bracket by a plurality of connection components, the upper surface and the lower surface of the triangular bracket are each provided with first preset structures engaged with the plurality of connection components, and the first movable rail and the second movable rail are each provided with second preset structures engaged with the plurality of connection components.

The turnout apparatus for an overhead monorail according to the embodiments of the present invention includes a frame, an input fixed rail configured to dock an input rail, output fixed rails each configured to dock an output rail, and movable rails disposed between the input fixed rail and the output fixed rails. The input fixed rail is disposed at one end of the frame, the output fixed rails include a first output fixed rail and a second output fixed rail, and the first output fixed rail and the second output fixed rail are disposed at the other end of the frame. The movable rails include a first movable rail configured for simultaneously docking the input fixed rail and the first output fixed rail, and a second movable rail configured for simultaneously docking the input fixed rail and the second output fixed rail. The first movable rail and the second movable rail are fixed together and are both rotatable about a horizontal line as an axis, and directions toward which upper rail surfaces of the first movable rail and the second movable rail face differ by 180 degrees in a circumferential direction. It can be seen that with the turnout apparatus for the overhead monorail according to the embodiments of the present invention, by rotating the first movable rail and the second movable rail to change the track, accurate docking can be achieved during the track changing, thereby reducing the bumping of the overhead monorail and the wear of the wheels of the overhead monorail, and providing high safety and stability.

Other beneficial effects of the embodiments of the present invention will be further described in detailed description of the embodiments in conjunction with specific technical solutions.

DESCRIPTION OF THE EMBODIMENTS

Figure 1:
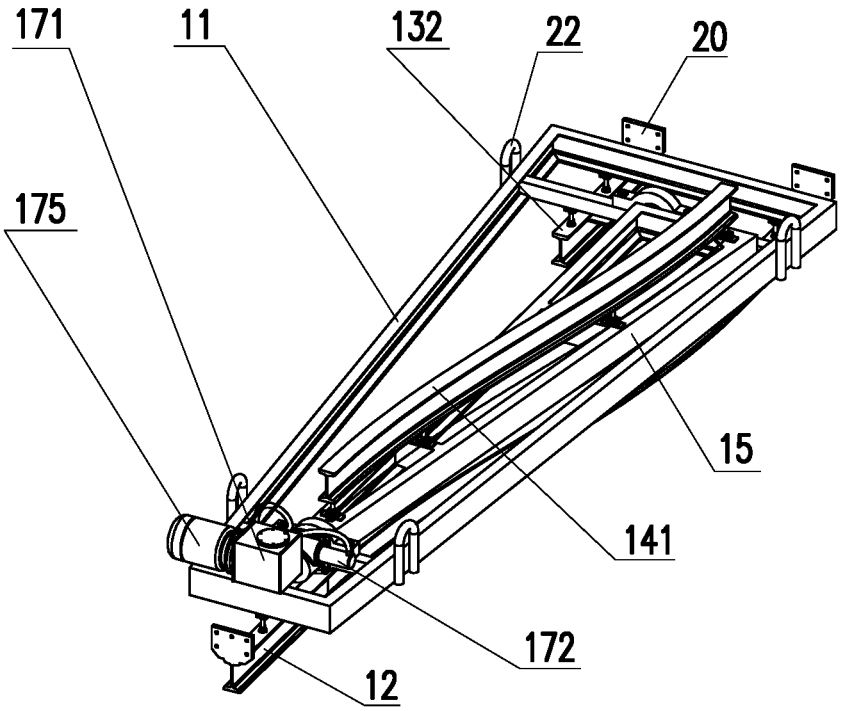
FIG. 1 is a schematic view of a turnout apparatus for an overhead monorail in a mine according to an embodiment of the present invention.

It should be noted that in the description of the embodiments of the present invention, unless otherwise specified and defined, the term "connect" or any variant thereof should be understood in a broad sense. For example, it may be an electrical connection, or a communication between two components, and may be a direct connection, or an indirect connection via an intermediate medium. For those of ordinary skill in the art, the specific meaning of the above terms can be understood according to specific circumstances.

It should be noted that the terms such as "first/second/third" as used in the embodiments of the present invention are only for distinguishing similar objects and do not represent a specific order for the objects. It should be understood that "first/second/third" can be interchanged in a specific order or sequence when permitted. It should be understood that the objects distinguished by "first\second\third" can be interchanged under appropriate circumstances, so that the embodiments of the present invention described herein can be implemented in an order other than those illustrated or described herein.

The embodiments of the present invention provide a turnout apparatus for an overhead monorail, including a frame, an input fixed rail configured to dock an input rail, output fixed rails each configured to dock an output rail, and movable rails disposed between the input fixed rail and the output fixed rails. The input fixed rail is disposed at one end of the frame, the output fixed rails include a first output fixed rail and a second output fixed rail, and the first output fixed rail and the second output fixed rail are disposed at the other end of the frame. The movable rails include a first movable rail configured for simultaneously docking the input fixed rail and the first output fixed rail, and a second movable rail configured for simultaneously docking the input fixed rail and the second output fixed rail. The first movable rail and the second movable rail are fixed together and are both rotatable about a horizontal line as an axis, and directions toward which upper rail surfaces of the first movable rail and the second movable rail face differ by 180 degrees in a circumferential direction.

The turnout apparatus for an overhead monorail according to the embodiments of the present invention is applied to a railroad with two branch tracks, i.e., one input rail and two output rails. It should be understood that the turnout apparatus can also be applied to a railroad with more branch tracks.

The input fixed rail, the first output fixed rail and the second output fixed rail (which will be hereinafter briefly referred to as fixed rails) are all used for connecting to an input rail or output rail, and therefore are provided with a related structure for connecting to the rail. The related structure may be a connection plate.

Compared with the prior art where the movable rail is moved, with the turnout apparatus for an overhead monorail according to the embodiments of the present invention, by rotating the first movable rail and the second movable rail to change the track, more accurate docking can be achieved during the track changing, thereby reducing the bumping of the overhead monorail and the wear of the wheels of the overhead monorail, and providing high safety and stability. Because the two output rails generally are not parallel, the movement of the movable rail in the prior art is usually swaying. That is to say, the movement trajectory of the movable rail is in the shape of an arc. As a result, there is an angle and gap between the fixed rail and the movable rail, leading to inaccurate docking. Changing the track through rotation can solve this problem.

In addition, for the method of changing the track through rotation, the power from the switch mechanism and the gravity of the movable rail makes the position of the movable rail after the change more stable, and the movable rail will not move during the running of the overhead monorail, thereby further reducing the bumping of the overhead monorail and the wear to the wheels of the overhead monorail.

In an implementation, the apparatus further includes a triangular bracket, the triangular bracket includes an input end corresponding to the input rail and an output end corresponding to the output rail, the input end and the output end are each provided with a shaft head, the triangular bracket is rotatably mounted on the frame through the shaft heads, and the frame is provided with supporting bearings engaged with the shaft heads. The first movable rail and the second movable rail are respectively fixed above and below the triangular bracket, and when the triangular bracket rotates, the first movable rail and the second movable rail both rotate about the horizontal line as the axis. This facilitates the mounting of the movable rails, and is also suitable for a railroad with two branch tracks, providing a stable structure. It should be understood that other shapes such as a trapezoid may also be adopted.

In an implementation, the apparatus further includes a driving device configured to drive the triangular bracket to rotate, and the driving device is disposed at the end of the frame corresponding to either the input end or the output end of the triangular bracket. It should be understood that the triangular bracket may also be rotated manually.

In an implementation, the frame further includes a limiting block configured to limit a rotation angle of the triangular bracket, and the limiting block is located within a rotation radius of the triangular bracket. When the first movable rail simultaneously docks the input fixed rail and the first output fixed rail, an upper surface of the triangular bracket rests against the limiting block, and when the second movable rail simultaneously docks the input fixed rail and the second output fixed rail, a lower surface of the triangular bracket rests against the limiting block. In this way, the position at which the movable rail stops after rotation can be controlled more accurately, thereby facilitating the docking with the fixed rails. It should be understood that the position of the movable rail after rotation can also be limited by setting the rotation angle through the driving device.

In an implementation, each of the movable rails is provided with arc-shaped sections in a traveling direction of the overhead monorail for docking the input fixed rail and a respective one of the output fixed rails, and the arc-shaped sections are of a preset size. In this way, the connection between the movable rail and the fixed rail is smooth connection, thereby further reducing the bumping of the overhead monorail and the wear of the wheels of the overhead monorail. The smooth connection may be a connection using the straight line as the tangent of the circle where the arc is located and using the connection point as the point of tangency in the case where the straight line and the arc are connected, and will not be detailed here.

In an implementation, each of the supporting bearings includes a bearing seat and a rolling bearing, the bearing seat is fixed on the frame, an outer race of the rolling bearing is fixed on the bearing seat, and an inner race of the rolling bearing is engaged with the shaft head of the triangular bracket. The rolling bearing experiences a small resistance and is not easily stuck due to its rolling friction, and the lubricant is well sealed and can provide lubrication for a long time, thereby better coping with harsh conditions, for example, in mines. For the method of changing the track through movement in the prior art, generally sliding friction is involved, which experiences a large resistance and is likely to get stuck, and the lubricant is not well sealed, leading to a poor lubrication effect.

In an implementation, the driving device is a first motor, and an output shaft of the first motor is connected to the shaft head of the triangular bracket. Specifically, the first motor is a stepper motor or servo motor, which not only can drive the triangular bracket to rotate but also can accurately control the rotation angle of the triangular bracket, thereby ensuring the accurate docking of the movable rail with the fixed rail.

In an implementation, the driving device includes a two-way hydraulic pump, a first hydraulic cylinder and a second hydraulic cylinder, the two-way hydraulic pump includes a first oil outlet connected to the first hydraulic cylinder and a second oil outlet connected to the second hydraulic cylinder, and piston rods of the first hydraulic cylinder and the second hydraulic cylinder are each connected to the shaft head of the triangular bracket through a pinion and rack mechanism. When oil is delivered out from the first oil outlet of the two-way hydraulic pump, the first hydraulic cylinder drives, through the pinion and rack mechanism, the shaft head of the triangular bracket to rotate clockwise. When oil is delivered out from the second oil outlet of the two-way hydraulic pump, the second hydraulic cylinder drives, through the pinion and rack mechanism, the shaft head of the triangular bracket to rotate counterclockwise. The use of the hydraulic system including the two-way hydraulic pump and the piston rods of the first hydraulic cylinder and the second hydraulic cylinder to drive the shaft head of the triangular bracket to rotate can achieve a high stability and lower failure rate compared with motor driving. Definitely, although only the hydraulic oil outlets of the two-way hydraulic pump are mentioned above, actually an oil return port is also needed. In other words, the two-way hydraulic pump not only includes the first oil outlet and the second oil outlet, but also includes corresponding to a first oil return port the first oil outlet and a second oil return port corresponding to the second oil outlet, which is understandable to a person skilled in the art and therefore will not be detailed here.

In an implementation, the first hydraulic cylinder and the second hydraulic cylinder may be the same hydraulic cylinder, that is, may be a double-acting hydraulic cylinder. As such, the pipeline configuration of the two-way hydraulic pump can also be simplified.

In an implementation, the driving device further includes a second motor configured to drive the two-way hydraulic pump, oil is delivered out from the first oil outlet of the two-way hydraulic pump when the second motor rotates clockwise, and oil is delivered out from the second oil outlet of the two-way hydraulic pump when the second motor rotates counterclockwise. In this way, the rotation direction of the movable rail can be controlled more conveniently by controlling the forward or reverse rotation of the second motor.

In an implementation, the first movable rail and the second movable rail are each fixed to the triangular bracket by a plurality of connection components, the upper surface and the lower surface of the triangular bracket are each provided with first preset structures engaged with the plurality of connection components, and the first movable rail and the second movable rail are each provided with second preset structures engaged with the plurality of connection components. Here, the connection components may be bolts, the first preset structure may be a slot adapted to fix a head portion of the bolt, and the second preset structure may be a threaded hole. Such a structure is simple and easy to disassemble. It should be understood that the connection component may also be other components, for example, may be a steel I-beam. One end of the steel I-beam is fixed to the first movable rail or the second movable rail, and the other end is fixed to the triangular bracket. The fixing may be threaded fixing.

The present invention will be further described below with reference to the accompanying drawings and specific embodiments. It should be understood that the specific embodiments described herein are merely used for explaining the present invention, and are not intended to limit the present invention.

Figure 2:
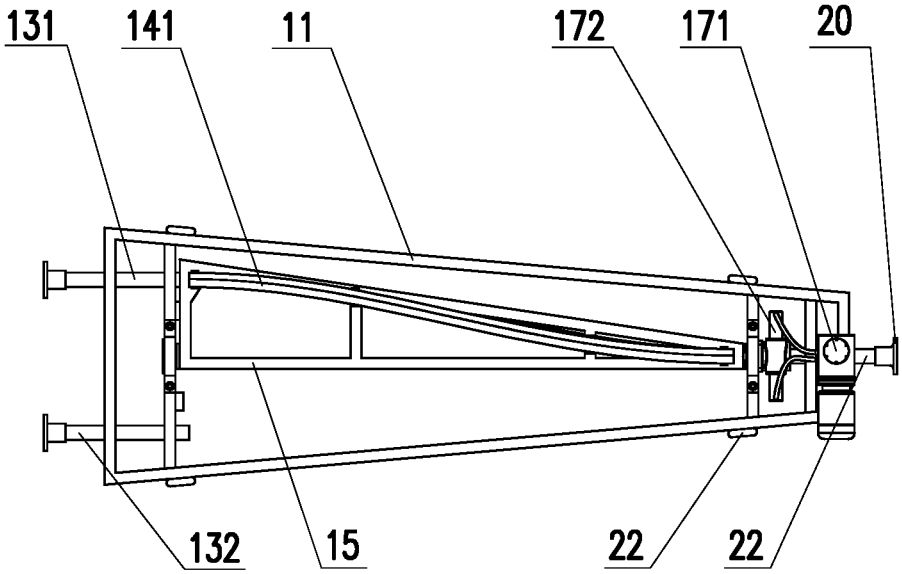
FIG. 2 is a schematic top view of FIG. 1.

As shown in FIG. 1 and FIG. 2, this embodiment provides a turnout apparatus for an overhead monorail in a mine. The apparatus includes a frame 11, the input fixed rail 12, output fixed rails and movable rails. The input fixed rail 12 is disposed at one end of the frame 11. The output fixed rails include a first output fixed rail 131 and a second output fixed rail 132. The first output fixed rail 131 and the second output fixed rail 132 are disposed at the other end of the frame 11. The movable rails include a first movable rail 141 configured for simultaneously docking the input fixed rail 12 and the first output fixed rail 131, and a second movable rail 142 configured for simultaneously docking the input fixed rail 12 and the second output fixed rail 132. The first movable rail 141 and the second movable rail 142 are respectively fixed above and below the triangular bracket 15. The triangular bracket 15 is rotatable about the horizontal line as an axis. That is, directions toward which upper rail surfaces of the first movable rail 141 and the second movable rail 142 face differ by 180 degrees in a circumferential direction.

Figure 3:
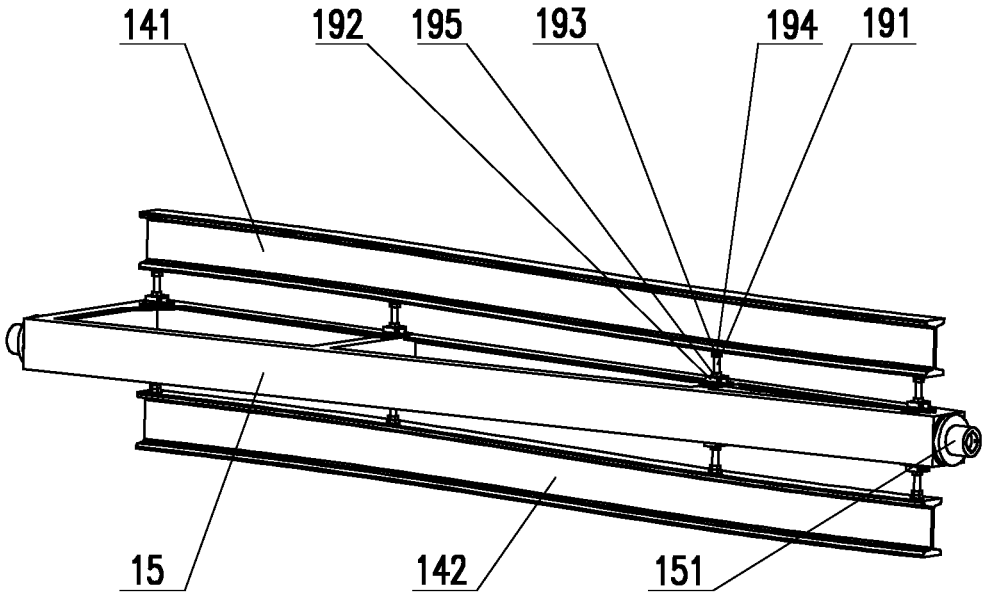
FIG. 3 is a schematic view of a triangular bracket and movable rails in the turnout apparatus for the overhead monorail in a mine according to the embodiment of the present invention.
Figure 4:
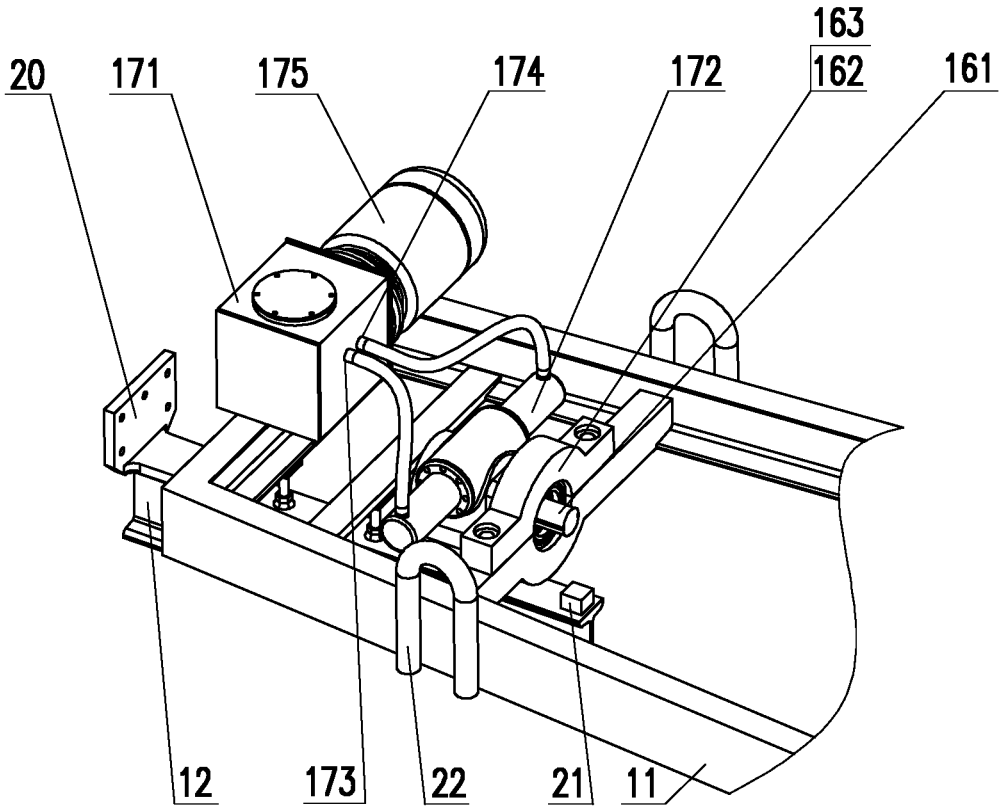
FIG. 4 is a schematic partial view of one end, on which a driving device is mounted, of the turnout apparatus for the overhead monorail in a mine according to the embodiment of the present invention.

As shown in FIG. 3, in an implementation, the triangular bracket 15 includes an input end corresponding to the input rail and an output end corresponding to the output rail. The input end and the output end are each provided with a shaft head 151. The triangular bracket 15 is rotatably mounted on the frame 11 through the shaft heads 151. The frame 11 is disposed at two ends thereof with supporting bearings engaged with the shaft heads 151. Specifically, for the convenience of mounting, as shown in FIG. 4, a coupling shaft 161 is mounted in the supporting bearing at one end of the frame 11, the shaft head 151 at one end of the triangular bracket 15 is connected to the coupling shaft 161, and the shaft head 151 at the other end of the triangular bracket 15 is directly connected to the supporting bearing. In this way, the triangular bracket 15 can rotate relative to the frame 11 through the shaft heads 151, the coupling shaft 161, and the supporting bearings. As can be seen from FIG. 3, the first movable rail 141 and the second movable rail 142 are both located on the right side of the triangular bracket. In this way, the second movable rail 142 below the triangular bracket 15 docks the first output fixed rail 131 on the right side of the triangular bracket 15. When the first movable rail 141 rotates to below the triangular bracket 15, the first movable rail 141 is located on the left side of the triangular bracket 15, and can dock the second output fixed rail 132 on the left side of the triangular bracket 15, so as to change the track.

In an implementation, the apparatus further includes a driving device configured to drive the triangular bracket 15 to rotate, and the driving device is disposed at the end of the frame 11 corresponding to either the input end or the output end of the triangular bracket 15.

Figure 6:
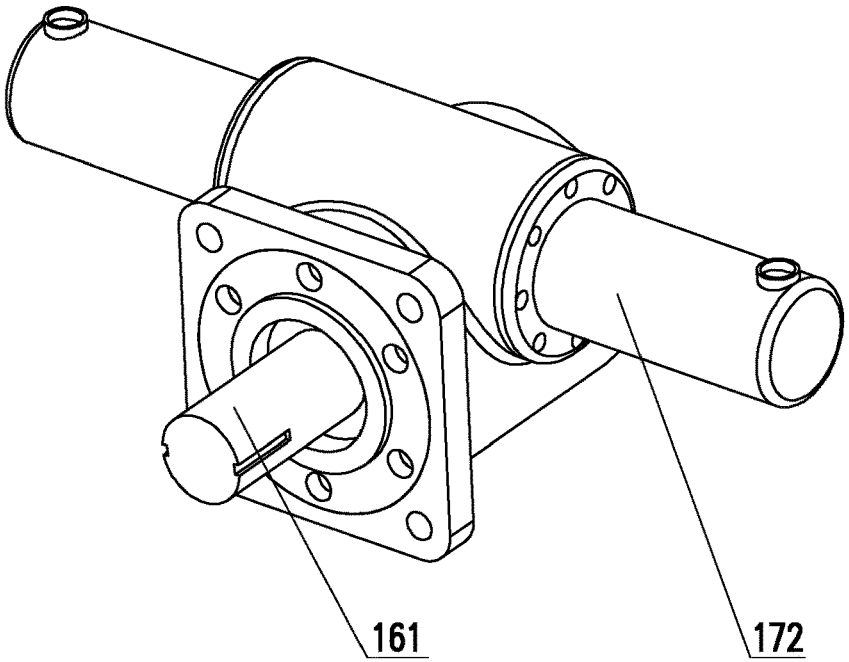
FIG. 6 is a schematic view of a double-acting hydraulic cylinder in the turnout apparatus for the overhead monorail in a mine according to the embodiment of the present invention.
Figure 7:
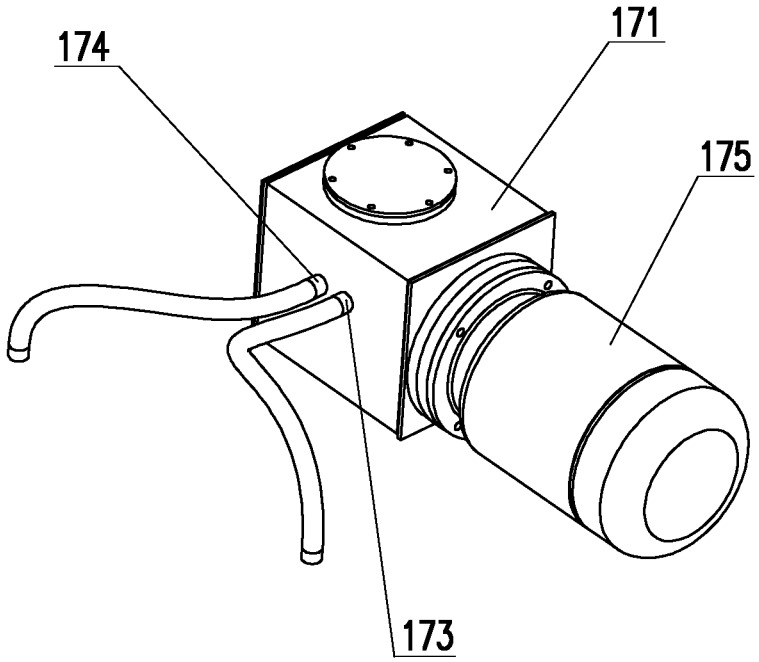
FIG. 7 is a schematic view of a two-way hydraulic pump in the turnout apparatus for the overhead monorail in a mine according to the embodiment of the present invention.

Specifically, as shown in FIG. 4, FIG. 6, and FIG. 7, the driving device includes a two-way hydraulic pump 171 and a double-acting hydraulic cylinder 172. The two-way hydraulic pump 171 includes a first oil outlet 173 and a second oil outlet 174 respectively connected to two oil inlets of the double-acting hydraulic cylinder 172. A piston rod (not shown) of the double-acting hydraulic cylinder 172 is connected to the shaft head 151 of the triangular bracket 15 through a pinion and rack mechanism (not shown). When oil is delivered out from the first oil outlet 173 of the two-way hydraulic pump 171, oil is delivered into the double-acting hydraulic cylinder 172 through the oil inlet on the left, and the piston rod moves rightward to drive, through the pinion and rack mechanism, the shaft head 151 of the triangular bracket 15 to rotate clockwise. When oil is delivered out from the second oil outlet 174 of the two-way hydraulic pump 171, oil is delivered into the double-acting hydraulic cylinder 172 through the oil inlet on the right, and the piston rod moves leftward to drive, through the pinion and rack mechanism, the shaft head 151 of the triangular bracket 15 to rotate counterclockwise. The use of the hydraulic system including the two-way hydraulic pump 171 and the double-acting hydraulic cylinder 172 to drive the shaft head 151 of the triangular bracket 15 to rotate can achieve a high stability and lower failure rate compared with motor driving. Specifically, the driving device drives the coupling shaft 161, which then drives the shaft head 151 to rotate.

Specifically, the two-way hydraulic pump 171 is placed in a hydraulic cabinet. A majority of the hydraulic cabinet is filled with a hydraulic oil. The two-way hydraulic pump 171 shown in the figure is actually a housing of the hydraulic cabinet.

Figure 5:
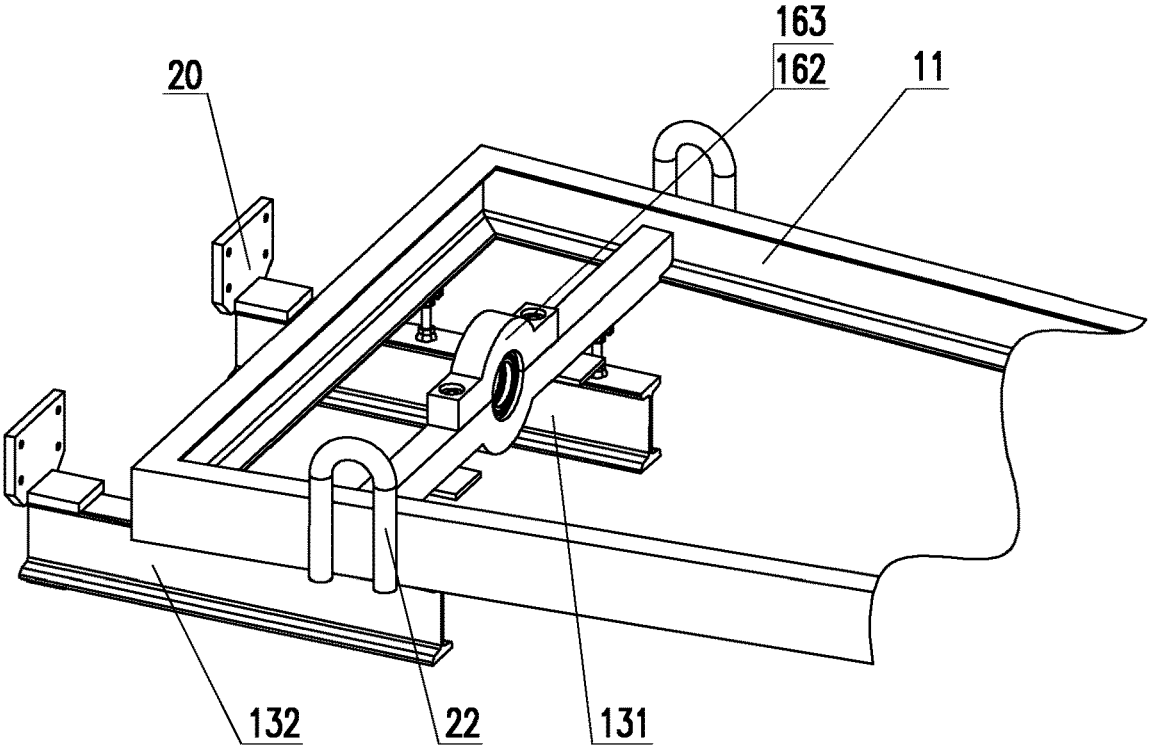
FIG. 5 is a schematic partial view of the other end, on which no driving device is mounted, of the turnout apparatus for the overhead monorail in a mine according to the embodiment of the present invention.

In an implementation, as shown in FIG. 4 and FIG. 5, the frame 11 further includes a limiting block 181 configured to limit a rotation angle of the triangular bracket 15, and the limiting block 181 is located within a rotation radius of the triangular bracket 15. When the first movable rail 141 simultaneously docks the input fixed rail 12 and the first output fixed rail 131, an upper surface of the triangular bracket 15 rests against the limiting block 181, and when the second movable rail 142 simultaneously docks the input fixed rail 12 and the second output fixed rail 132, a lower surface of the triangular bracket 15 rests against the limiting block 181. In this way, the position at which the movable rail stops after rotation can be controlled more accurately, thereby facilitating the docking with the fixed rails.

In an implementation, each of the movable rails is provided with arc-shaped sections in a traveling direction of the overhead monorail for docking the input fixed rail 12 and a respective one of the output fixed rails, and the arc-shaped sections are of a preset size. In other words, each of the movable rails is in the form of a curve in the movement direction of the overhead monorail. In this way, the connection between the movable rail and the fixed rail is smooth, thereby further reducing the bumping of the overhead monorail and the wear to the wheels of the overhead monorail.

In an implementation, as shown in FIG. 4 and FIG. 5, the supporting bearing includes a bearing seat 162 and a rolling bearing 163, the bearing seat 162 is fixed on the frame 11, an outer race of the rolling bearing 163 is fixed on the bearing seat 162, and an inner race of the rolling bearing 163 is engaged with the shaft head 151 of the triangular bracket 15. The rolling bearing 163 experiences a small resistance and is not easily stuck due to its rolling friction, and the lubricant is well sealed and can provide lubrication for a long time, thereby better coping with harsh conditions, for example, in mines.

In an implementation, as shown in FIG. 4 and FIG. 7, the driving device further includes a second motor 175 configured to drive the two-way hydraulic pump 171, oil is delivered out from the first oil outlet 173 of the two-way hydraulic pump 171 when the second motor 175 rotates clockwise, and oil is delivered out from the second oil outlet 174 of the two-way hydraulic pump 171 when the second motor 175 rotates counterclockwise. In this way, the rotation direction of the movable rail can be controlled more conveniently by controlling the forward or reverse rotation of the second motor 175.

Figure 8:
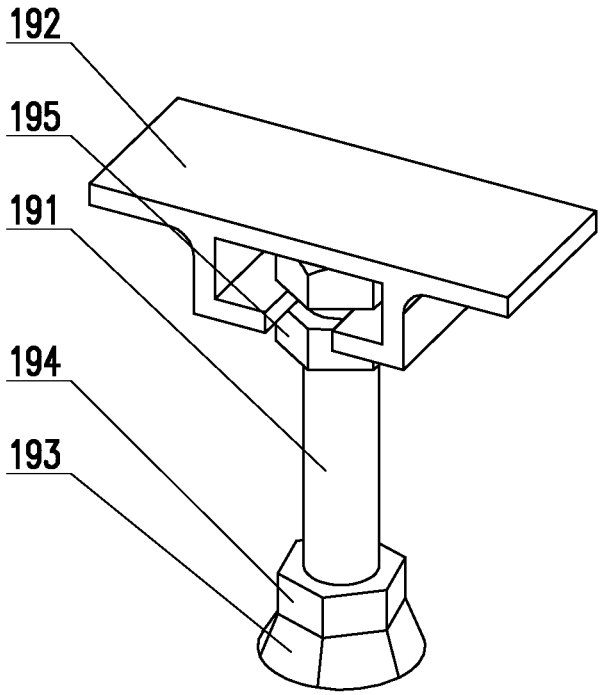
FIG. 8 is a schematic view showing connection between a bolt and a threaded base in the turnout apparatus for the overhead monorail in a mine according to the embodiment of the present invention.
Figure 9:
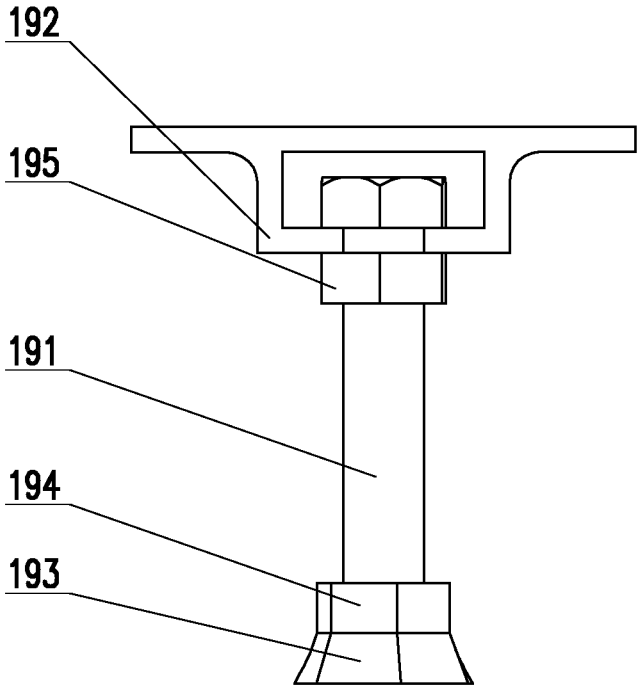
FIG. 9 is a schematic orthographic projection view of FIG. 8.

In an implementation, the first movable rail 141 and the second movable rail 142 may be each fixed to the triangular bracket 15 by a plurality of connection components. As shown in FIG. 8 and FIG. 9, the connection components are bolts 191. The first movable rail 141 and the second movable rail 142 are each fixed to the triangular bracket 15 by a plurality of bolts 191. The upper surface and the lower surface of the triangular bracket 15 are each provided with connection bases 192 engaged with the bolts 191. The first movable rail 141 and the second movable rail 142 are each provided with threaded bases 193 engaged with the bolts 191. In this way, convenient connection and disassembly are achieved. A specific assembly method may be as follows: First, the connection base 192 is fixed to the upper surface of the triangular bracket 15, and then the threaded base 193 is fixed to the bottom of the movable rail. Then, two nuts are sleeved on the bolt 191. The rod of the bolt 191 sleeved with the nuts is screwed into the threaded base 193 and tightened, and a first nut 194 of the two nuts is tightened, so that an end surface of the first nut 194 rests against the bottom of the movable rail. The movable rail is moved, and a head portion of the bolt 191 is laterally inserted into the connection base 192. Because the bolt 191 has been connected to the movable rail, i.e., the entire movable rail is connected to the triangular bracket 15, a second nut 195 of the two nuts is then tightened, so that an end surface of the second nut 195 rests against the connection base 192. Such a structure is simple and easy to disassemble.

In an implementation, as shown in FIG. 1 and FIG. 2, the apparatus further includes a connection plate 20. The connection plate 20 is disposed at end portions of the input fixed rail 12, the first output fixed rail 131 and the second output fixed rail 132, and is configured to connect the input rail or the output rails.

In an implementation, as shown in FIG. 4, the apparatus further includes a position sensor 21. The position sensor 21 is provided on the frame 11. After the movable rail rotates and docks the fixed rail, the position sensor 21 can detect the movable rail. If the position of the movable rail deviates, i.e., if the movable rail is not rotated to a correct position, the position sensor 21 cannot detect the movable rail, and accordingly sounds an alarm, and sends out a fault signal. The fault signal is transmitted back to the driver's cab and the central control room, so that the central control room automatically switches a signal light on the road to a No Passing state or red to avoid damage to the overhead monorail during driving, and notifies maintenance personnel. The maintenance personnel receives the fault signal and performs maintenance.

The signal light on the road may also be switched to the No Passing state or red manually by the maintenance personnel, not by the driver's cab or the central control room, and then maintenance can be performed. This is applicable to a case where the control from the central control room fails or is for the purpose of simplifying the control system of the central control room.

In an implementation, as shown in FIG. 1 and FIG. 2, the apparatus further includes lifting lugs 22, and the lifting lugs 22 are configured to fix the apparatus to a top wall of a coal mine roadway.

The present invention has been described in detail with reference to preferred embodiments, which however are not intended to limit the scope of protection of the present invention. Any modifications, equivalent improvements and substitutions can be made without departing from the spirit and principle of the present invention, which are all fall within the scope of protection of the present invention.

INDUSTRIAL APPLICABILITY

With the turnout apparatus for an overhead monorail according to the embodiments of the present invention, by rotating the first movable rail and the second movable rail to change the track, accurate docking can be achieved during the track changing, thereby reducing the bumping of the overhead monorail and the wear of the wheels of the overhead monorail, and providing high safety and stability.

What is claimed is:

1. A turnout apparatus for an overhead monorail, the turnout apparatus comprising a frame, an input fixed rail configured to dock an input rail, output fixed rails each configured to dock an output rail, and movable rails disposed between the input fixed rail and the output fixed rails; the input fixed rail is disposed at one end of the frame, the output fixed rails comprise a first output fixed rail and a second output fixed rail, and the first output fixed rail and the second output fixed rail are disposed at the other end of the frame;

the movable rails comprise a first movable rail configured for simultaneously docking the input fixed rail and the first output fixed rail, and a second movable rail configured for simultaneously docking the input fixed rail and the second output fixed rail; the first movable rail and the second movable rail are fixed together and are both rotatable about a horizontal line as an axis, and directions toward which upper rail surfaces of the first movable rail and the second movable rail face differ by 180 degrees in a circumferential direction, wherein the turnout apparatus further comprises a triangular bracket, the triangular bracket comprises an input end corresponding to the input rail and an output end corresponding to the output rails, the input end and the output end are each provided with a shaft head, the triangular bracket is rotatably mounted on the frame through the shaft heads, and the frame is provided with supporting bearings engaged with the shaft heads; and the first movable rail and the second movable rail are respectively fixed above and below the triangular bracket, and when the triangular bracket rotates, the first movable rail and the second movable rail both rotate about the horizontal line as the axis, wherein the a rotation angle of the triangular bracket, and the limiting block is located within a rotation radius range of the triangular bracket; and when the first movable rail simultaneously docks the input fixed rail and the first output fixed rail, an upper surface of the triangular bracket rests against the limiting block, and when the second movable rail simultaneously docks the input fixed rail and the second output fixed rail, a lower surface of the triangular bracket rests against the limiting block.

2. The turnout apparatus according to claim 1, wherein the turnout apparatus further comprises a driving device configured to drive the triangular bracket to rotate, and the driving device is disposed at the end of the frame corresponding to any one of the input end and the output end of the triangular bracket.

3. The turnout apparatus according to claim 2, wherein the driving device is a first motor, and an output shaft of the first motor is connected to the shaft head of the triangular bracket.

4. The turnout apparatus according to claim 2, wherein the driving device comprises a two-way hydraulic pump, a first hydraulic cylinder and a second hydraulic cylinder, the two-way hydraulic pump comprises a first oil outlet and a second oil outlet respectively connected to the first hydraulic cylinder and the second hydraulic cylinder, and piston rods of the first hydraulic cylinder and the second hydraulic cylinder are each connected to the shaft head of the triangular bracket through a pinion and rack mechanism;

when oil is delivered out from the first oil outlet of the two-way hydraulic pump, the first hydraulic cylinder drives, through the pinion and rack mechanism, the shaft head of the triangular bracket to rotate clockwise; and when oil is delivered out from the second oil outlet of the two-way hydraulic pump, the second hydraulic cylinder drives, through the pinion and rack mechanism, the shaft head of the triangular bracket to rotate counterclockwise.

5. The turnout apparatus according to claim 4, wherein the driving device further comprises a second motor configured to drive the two-way hydraulic pump, oil is delivered out from the first oil outlet of the two-way hydraulic pump when the second motor rotates clockwise, and oil is delivered out from the second oil outlet of the two-way hydraulic pump when the second motor rotates counterclockwise.

6. The turnout apparatus according to claim 2, wherein each of the movable rails is provided with arc-shaped sections docking the input fixed rail and a respective one of the output fixed rails in a traveling direction of the overhead monorail, and the arc-shaped sections are of a preset size.

7. The turnout apparatus according to claim 2, wherein each of the supporting bearings comprises a bearing seat and a rolling bearing, the bearing seat is fixed on the frame, an outer race of the rolling bearing is fixed on the bearing seat, and an inner race of the rolling bearing is engaged with the shaft head of the triangular bracket.

8. The turnout apparatus according to claim 1, wherein each of the movable rails is provided with arc-shaped sections docking the input fixed rail and a respective one of the output fixed rails in a traveling direction of the overhead monorail, and the arc-shaped sections are of a preset size.

9. The turnout apparatus according to claim 1, wherein each of the supporting bearings comprises a bearing seat and a rolling bearing, the bearing seat is fixed on the frame, an outer race of the rolling bearing is fixed on the bearing seat, and an inner race of the rolling bearing is engaged with the shaft head of the triangular bracket.

10. The turnout apparatus according to claim 1, wherein the first movable rail and the second movable rail are each fixed to the triangular bracket by a plurality of connection components, the upper surface and the lower surface of the triangular bracket are each provided with first preset structures engaged with the plurality of connection components, and the first movable rail and the second movable rail are each provided with second preset structures engaged with the plurality of connection components.

* * * * *